US005586660A

United States Patent [19]

Buchfink

[11] Patent Number: 5,586,660

[45] Date of Patent: Dec. 24, 1996

[54] PROCESS AND APPARATUS FOR SCREENING A STREAM OF BULK MATERIAL

[75] Inventor: Adolf Buchfink, Rosengarten, Germany

[73] Assignee: Claudius Peters Aktiengesellschaft, Buxtehude, Germany

[21] Appl. No.: 360,794

[22] PCT Filed: May 10, 1994

[86] PCT No.: PCT/EP94/01504

§ 371 Date: Jan. 6, 1995

§ 102(e) Date: Jan. 6, 1995

[87] PCT Pub. No.: WO94/26428

PCT Pub. Date: Nov. 24, 1994

[30] Foreign Application Priority Data

May 10, 1993 [DE] Germany ..... 9307072 U

[51] Int. Cl.[6] ..... B03B 1/00

[52] U.S. Cl. ..... 209/3; 209/312; 209/318; 209/321

[58] Field of Search ..... 209/250, 352, 209/353, 357, 358, 367, 375, 474, 23, 27, 29, 31, 35, 37, 44, 10, 254, 3, 318, 321, 236, 245, 312

[56] References Cited

U.S. PATENT DOCUMENTS 2,200,472 5/1940 Erdmann ..... 209/27

FOREIGN PATENT DOCUMENTS 2219179 10/1973 Germany ..... B07B 1/00
671232 4/1952 United Kingdom .

*Primary Examiner*—David H. Bollinger
*Attorney, Agent, or Firm*—Chilton, Alix & Van Kirk

[57] ABSTRACT

The screening of a stream of bulk material is accelerated so that this takes place in the state of the fluidized bed. The screening apparatus can be made correspondingly smaller. So that the fluidized-bed state persists over the screen surface, the latter is made short and, if necessary, a plurality of screen surfaces with interposed aerating stages are connected in succession.

11 Claims, 2 Drawing Sheets

PROCESS AND APPARATUS FOR SCREENING A STREAM OF BULK MATERIAL

Figure 1:
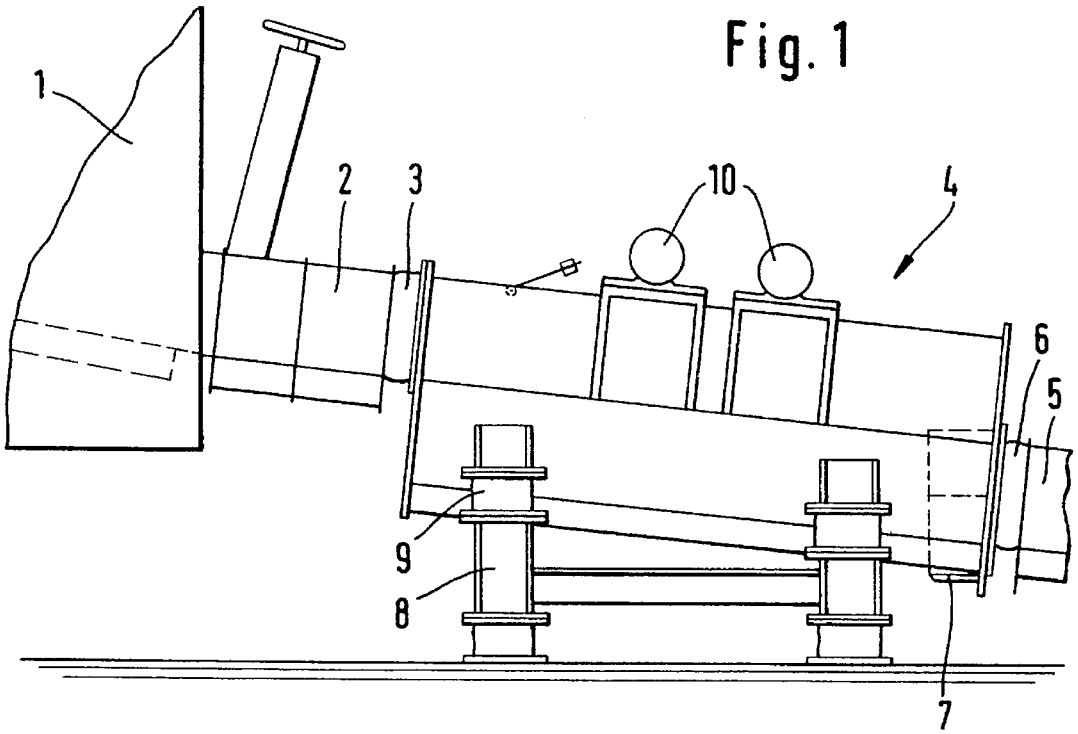

It is customary, in the screening of a stream of bulk material, to administer the stream of bulk material from above to the screen surface, on which it is distributed in layer form. By vibration and/or a descending gradient, the layer can be kept in motion and the screen overflow conveyed away. Even when the layer is kept in motion by vibration, it is in a comparatively dense settled state.

U.S. Pat. No. 2,200,472 discloses a screening apparatus for removing dust and coarse foreign bodies from a rubber granulate, in which the material is guided by way of a screen surface arranged at an inclination, through which passes from the bottom upwards a gas stream which lifts the dust and foreign bodies of low specific gravity to a greater extent than the granulate which is lifted to a lesser extent and which, after the stream of bulk material has passed through, falls back onto the screen. In the region of the air jet itself, the granulate cannot fall through the screen counter to the effect of the air jet. Whether, after the air-jet region, it is in a state conducive to the screening effect is not disclosed in the publication.

It is also known from DE-A-2,219,179 to separate light-weight fractions from a stream of bulk material to be screened, by means of a blowing stream passing through upwards from below. The screenability of the remaining particles is not varied thereby, since, when the air stream passes through, they do not lose contact with the conveying surface.

The invention relates to a screening apparatus, in which a stream of bulk material is to flow for the greatest part through a screen surface, whilst only foreign bodies, such as pieces of metal or lumps of material, are retained. The object on which it is based is to reduce the screen surface required for this purpose.

In the solution according to the invention, the screen surface is preceded, with approximately the same conveying direction, by a fluidized-bed conveying surface in the conveying path of the stream of bulk material. As a result, the stream of bulk material passes as a fluidized bed onto the screen surface. In the fluidized-bed state, the bulk material (at least its fraction of finer grain) is flowable. This makes the movement actions associated with the screening operation easier, in particular, on the one hand, the passage of the screen underflow through the screen apertures and, on the other hand, the separation within the material bed. The screening capacity per unit area of the screen surface is increased thereby; the necessary extent of the screen surface is reduced. The height requirement consequently decreases simultaneously. The fluidized-bed conveying surface can be a conventional pneumatic conveying trough, through the porous bottom of which gas is introduced into the material bed lying on the conveying surface, with the result that this material bed is converted into the flowable state. The conveying movement can be induced by an appropriate descending gradient of the conveying surface.

The fluidized-bed state cannot be maintained for long above the screen surface, because the gas establishing the fluidized state and separating the particles from one another can easily flow off upwards and downwards. It is therefore expedient if the screen surface is so short in the conveying direction in relation to the conveying speed that the fluidized-bed state of the screen overflow is maintained. More precisely, at the end of the screen-conveyor stage, the bulk-material bed should be in a state in which it is still so flowable that it can flow off from the screen surface. At the same time, the remaining operating conditions, in particular the descending gradient and a possibly provided vibration of the screen surface, are also to be taken into account. These influences have a beneficial effect on the conveyance and flowability of the material bed. If a descending gradient or vibration are added, the fluidized state therefore need not be so pronounced at the end of the screening stage that the material could still flow off solely as a result of this fluidized state.

In view of these facts, limits are placed on the length of the screening stage if a regeneration of the fluidized state by the supply of gas does not take place there. It can therefore be that the screening stage is shorter than would be necessary for screening off the entire fine fraction. In this case, according to the invention, a plurality of fluidized-bed conveying surfaces and screen surfaces can be arranged in succession. The entire screening apparatus then becomes a series of a plurality of segments of pneumatic conveying troughs in alternation with screening segments preferably interposed in the same plane, the screening segments each being kept so short that further conveyance does not falter on them, whilst the pneumatic conveying-trough segments are so long that the necessary fluidized-bed state can be restored on them.

In order to accelerate the throughflow of flowable material through the screen surfaces, a device for generating a differential pressure conducive to the screen passage can be provided. The use of a differential pressure on a screen surface is known per se (GB-A-671,232).

Figure 2:
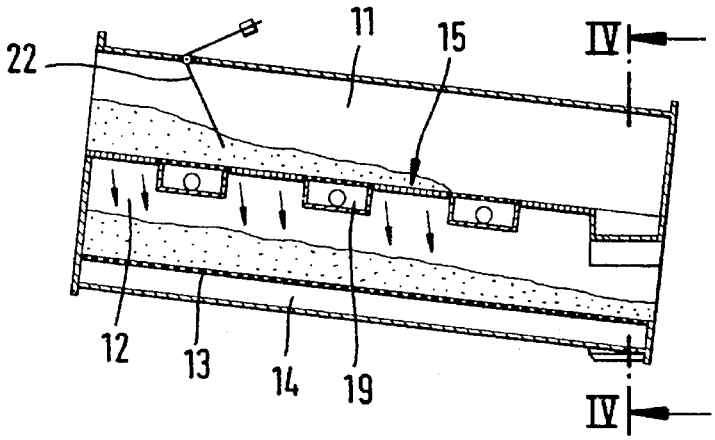
Figure 3:
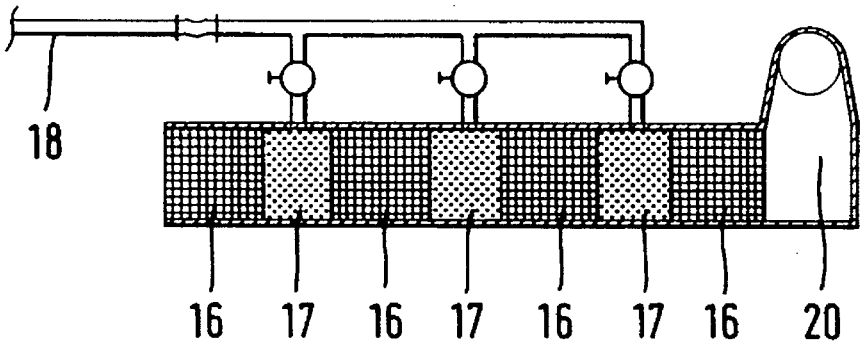
Figure 4:
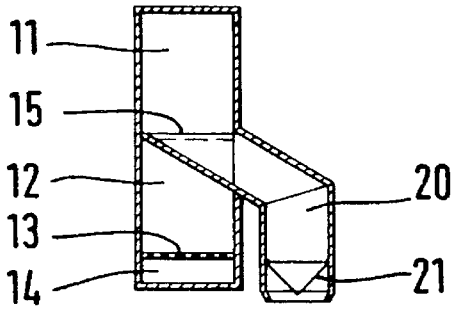

The invention is explained in more detail below with reference to the drawing which illustrates diagrammatically an advantageous exemplary embodiment. In the drawing:

FIG. 1 shows the side view of part of an installation having the screening apparatus according to the invention, FIG. 2 shows a longitudinal section through the screening apparatus, FIG. 3 shows a top view of the screening apparatus, and FIG. 4 shows a cross-section along the line IV—IV of FIG. 2.

In the example according to FIG. 1, a pneumatic conveying trough 2 is connected to the outlet of a bulk-material container 1. The pneumatic conveying trough 2 is a known conveying element which has, as the bottom of a closed conveying channel, an air-permeable plate loaded, by an air-supply channel located under it, with compressed air which, after passing through the bottom, penetrates into the material bed lying on the latter and converts it as a fluidized bed into the flowable state. It is set in conveying motion as a result of a slight descending gradient.

Connected to the pneumatic conveying trough 2 via an elastic compensator 3 is the screening apparatus, designated in general by 4, the underflow of which is guided further by a pneumatic conveying trough 5 which is connected to the screening apparatus via an elastic compensator 6. The overflow is discharged laterally at 7. The screening apparatus 4 is arranged on supports 8 by means of oscillating bearings 9 and is equipped with unbalance motors 10 which set them in vibration according to known principles.

The design of the screening apparatus emerges from FIG. 2. In it can be seen a screen upper space 11, the bottom of which adjoins the aerating bottom of the conveying trough 2 in alignment via the compensator 3. Located under it is a screen lower space 12 which is designed as a pneumatic conveying trough with an aerating bottom 13 and with an aerating space 14 for conveying away the screen underflow. The pneumatic conveying trough 5 is connected in alignment via the compensator 6 to the pneumatic conveying trough of this screen lower space.

Located between the upper space 11 and the lower space 12 is the bottom 15 which, as can be seen from the top view in FIG. 3, is composed of four screen surfaces or segments 16 and of aerating segments or bottoms 17 which are arranged in alignment between them and to which compressed air can be supplied from a conduit 18 having suitable adjusting members by way of the aerating spaces 19. These aerating bottoms and the aerating bottom of the conveying trough 2 were referred to above by the more general expression of fluidized-bed conveying surface.

There adjoins the last screen surface 16 a chute 20 which discharges the screen overflow and which is provided with closing flaps 21, in order, if necessary, to prevent the inflow and flow-off of air.

So that the material does not shoot through over the screening apparatus, a pendulum flap 22 can be provided above the start of the bottom 15 of the screening apparatus.

The material bed enters the screening apparatus from the pneumatic conveying trough 2 in the state of the fluidized bed. As a result of its fluidized state, the descending gradient and the vibration, it runs for a large part over and beyond the first screen surface or segment 16. This screen surface is made shorter than would be necessary for the completion of the screening operation. The fluidizing state of the fluidized bed is regenerated again over the subsequent aerating stage 16, so that it reaches the subsequent screening stage in the fluidized state and flows over it, and so forth. The screen overflow is discharged at the end of the screening apparatus by means of the chute 20.

If only coarse material is to be screened out from the conveying stream, all the screen surfaces 16 have an identical aperture size. It goes without saying that the apparatus can also be modified so that it can be used for grading.

I claim:

1. An apparatus for screening a stream of bulk material comprising a screening zone defining at least a portion of a conveying path for said stream of material, said screening zone comprising at least one fluidized-bed segment and an adjacent screening segment arranged successively within the conveying path, said fluidized-bed segment being effective to impart to the bulk material free-flowing, fluid-like behavior characteristics of a fluidized bed for conveyance in fluidized form along said path toward said adjacent screening segment.

2. The apparatus of claim 1 wherein the screening zone comprises a plurality of fluidized-bed segments and adjacent screening segments arranged successively along the conveying path, said fluidized-bed segments alternating with said screening segments.

3. The apparatus of claim 1 including a vibrating drive connected to said screening zone.

4. The apparatus of claim 1 wherein the fluidized-bed segment and the adjacent screening segment are combined to form a unit which can be jointly vibrated.

5. The apparatus of claim 1 including means for generating a differential pressure on opposite sides of the screening segments.

6. The apparatus of claim 1 wherein the screening zone includes an upper chamber for the conveying path extending along both the fluidized-bed segment and the screening segment, said upper chamber facilitating formation of a fluidized bed in the fluidized-bed segment and conveyance of the fluidized bed toward the screening segment.

7. The apparatus of claim 1 including aerating means in said fluidized-bed segment for supplying fluidizing gas thereto.

8. The apparatus of claim 1 including flow control means for constricting the depth of the bulk material stream conveyed along the conveying path.

9. A method of screening a stream of bulk material comprising the steps of treating the stream to form the bulk material into a fluidized bed, conveying the fluidized bed toward a screening zone, screening a portion of the material conveyed to the screening zone to effect separation thereof from the remaining material, conveying the remaining material beyond the screening zone, forming a secondary fluidized bed from the remaining material and subsequently conveying the secondary fluidized bed toward a secondary separation zone for further separation.

10. The method of claim 9 wherein the conveying steps are carried out along a descending gradient.

11. The method of claim 9 wherein the conveying steps are carried out using a vibratory drive.

* * * * *